US009726411B2

(12) United States Patent
Zimmermann

(10) Patent No.: US 9,726,411 B2
(45) Date of Patent: Aug. 8, 2017

(54) MODULATED OVERSIZED COMPRESSORS CONFIGURATION FOR FLASH GAS BYPASS IN A CARBON DIOXIDE REFRIGERATION SYSTEM

(71) Applicant: HEATCRAFT REFRIGERATION PRODUCTS LLC, Richardson, TX (US)

(72) Inventor: Augusto J. Pereira Zimmermann, Stone Mountain, GA (US)

(73) Assignee: Heatcraft Refrigeration Products L.L.C., Richardson, TX (US)

( * ) Notice: Subject to any disclaimer, the term of this patent is extended or adjusted under 35 U.S.C. 154(b) by 185 days.

(21) Appl. No.: 14/637,446

(22) Filed: Mar. 4, 2015

(65) Prior Publication Data

US 2016/0258662 A1 Sep. 8, 2016

(51) Int. Cl.

| | |
|---|---|
| ***F25B 49/02*** | (2006.01) |
| ***F25B 1/10*** | (2006.01) |
| ***F25B 9/00*** | (2006.01) |
| ***F25B 43/00*** | (2006.01) |
| *F25B 5/02* | (2006.01) |

(52) U.S. Cl.

CPC ..... *F25B 49/022* (2013.01); *F25B 1/10* (2013.01); *F25B 9/008* (2013.01); *F25B 43/00* (2013.01); *F25B 5/02* (2013.01); *F25B 2309/061* (2013.01); *F25B 2400/061* (2013.01); *F25B 2400/07* (2013.01); *F25B 2400/13* (2013.01); *F25B 2400/23* (2013.01)

(58) Field of Classification Search

CPC F25B 43/00; F25B 2400/061; F25B 2400/07; F25B 15/006; F25B 5/00; F25B 1/00; F25D 3/12

USPC ..... 62/115

See application file for complete search history.

(56) References Cited

U.S. PATENT DOCUMENTS

| | | | | |
|---|---|---|---|---|
| 3,766,745 | A | 10/1973 | Quick | |
| 8,113,008 | B2 * | 2/2012 | Heinbokel | F25B 1/10 62/228.3 |
| 8,671,704 | B2 | 3/2014 | Zimmermann et al. | |
| 2008/0110200 | A1 * | 5/2008 | Javerschek | F25B 9/008 62/515 |
| 2008/0264077 | A1 * | 10/2008 | Heinbokel | F25B 9/008 62/115 |

(Continued)

FOREIGN PATENT DOCUMENTS

| | | |
|---|---|---|
| DE | 10 2006 050232 | 2/2008 |
| EP | 0 076 716 | 4/1983 |

(Continued)

OTHER PUBLICATIONS

Extended European Search Report for Application No. EP 16 15 8824—Jul. 11, 2016.

*Primary Examiner* — Emmanuel Duke
(74) *Attorney, Agent, or Firm* — Baker Botts L.L.P.

(57) ABSTRACT

The present application provides a refrigeration system using a flow of a carbon dioxide refrigerant. The refrigeration system may include a flash tank, a number of temperature suction compressors for a temperature suction cycle, and a flash gas bypass system positioned between the flash tank and the cycle compressors. The flash gas bypass system may include one or more oversized flash gas compressors so as to alternate between the temperature suction cycle and a flash tank suction cycle.

15 Claims, 2 Drawing Sheets

(56) References Cited

U.S. PATENT DOCUMENTS

| | | | | |
|---|---|---|---|---|
| 2010/0199715 | A1* | 8/2010 | Lifson | F25B 40/00 62/510 |
| 2013/0283833 | A1* | 10/2013 | Huff | F25B 1/10 62/115 |
| 2013/0298593 | A1* | 11/2013 | Christensen | F25B 9/008 62/467 |
| 2013/0312376 | A1* | 11/2013 | Huff | F25B 1/10 55/457 |
| 2014/0208785 | A1* | 7/2014 | Wallace | F25B 9/008 62/115 |
| 2014/0326018 | A1* | 11/2014 | Ignatiev | F25B 49/02 62/510 |
| 2015/0345835 | A1* | 12/2015 | Martin | F25B 7/00 62/238.3 |

FOREIGN PATENT DOCUMENTS

| | | |
|---|---|---|
| WO | WO 2006 015741 | 2/2006 |
| WO | WO 2007 053149 | 5/2007 |
| WO | WO 2010 003555 | 1/2010 |
| WO | WO 2014 100330 | 6/2014 |

* cited by examiner

MODULATED OVERSIZED COMPRESSORS CONFIGURATION FOR FLASH GAS BYPASS IN A CARBON DIOXIDE REFRIGERATION SYSTEM

TECHNICAL FIELD

The present application and the resultant patent relate generally to refrigeration systems and more particularly relate to the use of modulated, oversized compressors for flash gas bypass in a transcritical carbon dioxide refrigeration system for an increase in efficiency with lower overall costs.

BACKGROUND OF THE INVENTION

Current refrigeration trends promote the use of carbon dioxide and other types of natural refrigerants as opposed to conventional hydrofluorocarbon based refrigerants. Although such carbon dioxide based refrigeration systems may be considered more environmentally friendly, such systems may be somewhat less efficient. Specifically, the carbon dioxide based refrigeration systems may require more overall power usage given a lower critical point and therefore higher throttling losses between the heat rejection and heat absorption processes as compared to a conventional refrigeration cycle.

In a transcritical carbon dioxide refrigeration system, the gaseous refrigerant may be cooled in a gas cooler to a temperature that is still above the critical point. The carbon dioxide refrigerant then may be discharged to a flash tank where the refrigerant may be expanded and separated into liquid and vapor. Such transcritical carbon dioxide refrigeration systems, however, may have a disadvantage during warmer months due to excessive vapor or flash gas generation during the expansion process in the flash tank. Accommodating this excessive flash gas generation may reduce overall refrigeration system efficiency and/or require the use of additional components and the related costs.

There is thus a desire for a refrigeration system using natural refrigerants such as carbon dioxide with improved efficiency. Preferably, such an improved refrigeration system may be environmentally friendly but with reduced overall operational and maintenance requirements and costs.

SUMMARY OF THE INVENTION

The present application and the resultant patent thus provide a refrigeration system using a flow of a carbon dioxide refrigerant. The refrigeration system may include a flash tank, a number of temperature suction compressors for a temperature suction cycle, and a flash gas bypass system positioned between the flash tank and the cycle compressors. The flash gas bypass system may include one or more oversized flash gas compressors so as to alternate between the temperature suction cycle and a flash tank suction cycle.

The present application and the resultant patent further provide a method of operating a refrigeration system. The method may include the steps of operating a suction cycle by compressing a suction flow by one or more oversized flash gas compressors and operating a flash tank suction cycle by compressing a flash gas flow by the one or more oversized flash gas compressors. The refrigeration system then may return to the suction cycle.

The present application and the resultant patent further provide a refrigeration system using a flow of a carbon dioxide refrigerant. The refrigeration system may include a flash tank, a number of mid-temperature cycle compressors, and a flash gas bypass system positioned between the flash tank and the mid-temperature cycle compressors. The flash gas bypass system may include one or more oversized flash gas compressors having a capacity of at least about fifty percent (50%) more than a mid-temperature cycle compressor.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
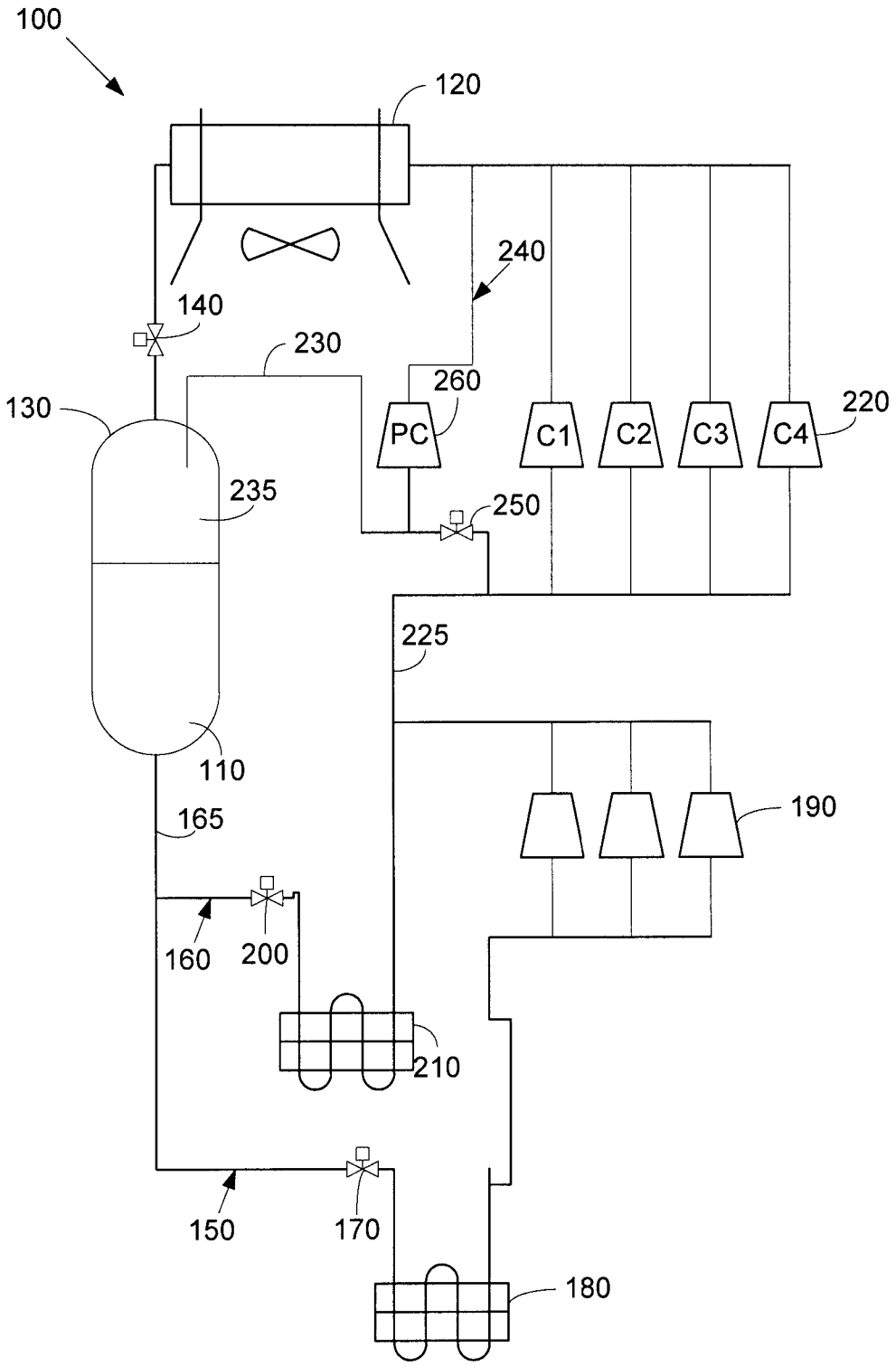
FIG. 1 is a schematic diagram of a transcritical carbon dioxide refrigeration system.

Referring now to the drawings, in which like numerals refer to like elements throughout the several views, FIG. 1 shows an example of a transcritical carbon dioxide refrigeration system 100. The transcritical carbon dioxide refrigeration system 100 may include a flow of a carbon dioxide refrigerant 110. Other types of refrigerants may be used herein. The transcritical carbon dioxide refrigeration system 100 may be used to cool any type of enclosure for use in, for example, supermarkets, cold storage, and the like. The transcritical carbon dioxide refrigeration system 100 also may be applicable to other types of heating, ventilation, and air conditioning applications and/or different types of commercial and/or industrial applications. The overall transcritical carbon dioxide refrigeration system 100 may have any suitable size, shape, configuration, or capacity. Other types of refrigeration systems, refrigeration cycles, and refrigeration components also may be used herein.

Generally described, the transcritical carbon dioxide refrigeration system 100 may include a gas cooler 120. The gas cooler 120 receives a gaseous flow of the carbon dioxide refrigerant 110 at about 90 bar or so and cools the refrigerant 110 to a temperature that is still above the critical point. The gas cooler 120 may be of conventional design and may have any suitable size, shape, configuration, or capacity. Other temperatures, other pressures, and other types of operating parameters may be used herein.

The flow of the carbon dioxide refrigerant 110 then may pass to a flash tank 130. The pressure of the flash tank 130 may be maintained at about 40 bar or so to allow a portion of the carbon dioxide refrigerant 110 to separate and liquefy. The flash tank 130 may have any suitable size, shape, configuration, or capacity. A high pressure expansion valve 140 may be positioned between the gas cooler 120 and the flash tank 130. The high pressure expansion valve 140 may control the flow of the carbon dioxide refrigerant 110 from the gas cooler 120 to the flash tank 130. The high pressure expansion valve 140 may be of conventional design and may have any suitable size, shape, configuration, or capacity.

The transcritical carbon dioxide refrigeration system 100 also may include a low temperature cycle 150 and a mid-temperature cycle 160. The low temperature cycle 150 and the mid temperature cycle 160 may be in communication with the flash tank 130 via a liquid line 165 for a flow of the liquid refrigerant 110. The low temperature cycle 150 may include a low temperature expansion valve 170, one or more low temperature evaporators 180, and a number of low temperature compressors 190. The low temperature compressors 190 may be positioned in a parallel configuration or otherwise. The components of the low temperature cycle 150 may be of conventional design and may have any suitable size, shape, configuration, or capacity. Likewise, the mid-temperature cycle 160 may include a mid-temperature expansion valve 200, one or more mid-temperature evaporators 210, and a number of mid-temperature compressors 220. The mid-temperature compressors 220 may be positioned in a parallel configuration or otherwise. Although four (4) mid-temperature compressors 220 are shown, any number may be used. The components of the mid-temperature cycle 160 may be of conventional design and may have any suitable size, shape, configuration, or capacity. Other components and other configurations may be used herein.

The low temperature compressors 190 and the mid-temperature compressors 220 may be arranged in a series configuration or otherwise. The mid-temperature compressors 220 may receive the refrigerant flow 110 as a suction flow via a suction line 225 at about 30 bar or so. The mid-temperature compressors 220 may compress the refrigerant flow 110 and forward the flow back to the gas cooler 120 so as to repeat the refrigeration cycle.

The flash tank 130 also may be in communication with the mid-temperature compressors 220 via a vapor line 230. As described above, the flash tank 130 may experience excessive generation of the vapor refrigerant 110 or a flash gas 235 during warmer months. The transcritical carbon dioxide refrigeration system 100 thus may include a flash gas bypass system 240. The flash gas bypass system 240 may include a flash gas bypass valve 250. The flash gas bypass valve 250 may be positioned on the vapor line 230. The flash gas bypass system 240 also may include one or more flash gas compressors 260. Although one flash gas compressor 260 is shown, any number may be used herein. The flash gas compressors 260 may be positioned in a parallel configuration or otherwise. The flash gas compressors 260 may be dedicated to the flow of the flash gas 235. The flash gas compressors 260 may be of conventional design and may have any suitable size, shape, configuration, or capacity.

In the case of excessive flash gas generation within the flash tank 130, the flash gas bypass valve 250 of the flash gas bypass system 240 may be activated such that the flash gas 235 may be directed towards the flash gas compressors 260. The use of the flash gas bypass system 240, however, may reduce the pressure to mid-temperature levels and therefore reduce overall system efficiency. Moreover, the dedicated flash gas compressors 260 may sit idle during cooler months with lower vapor generation. The flash gas bypass system 240 thus may have issues with both efficiency and overall costs. The transcritical carbon dioxide refrigeration system 100 and the flash gas bypass system 240 described herein are for the purpose of example only.

Figure 2:
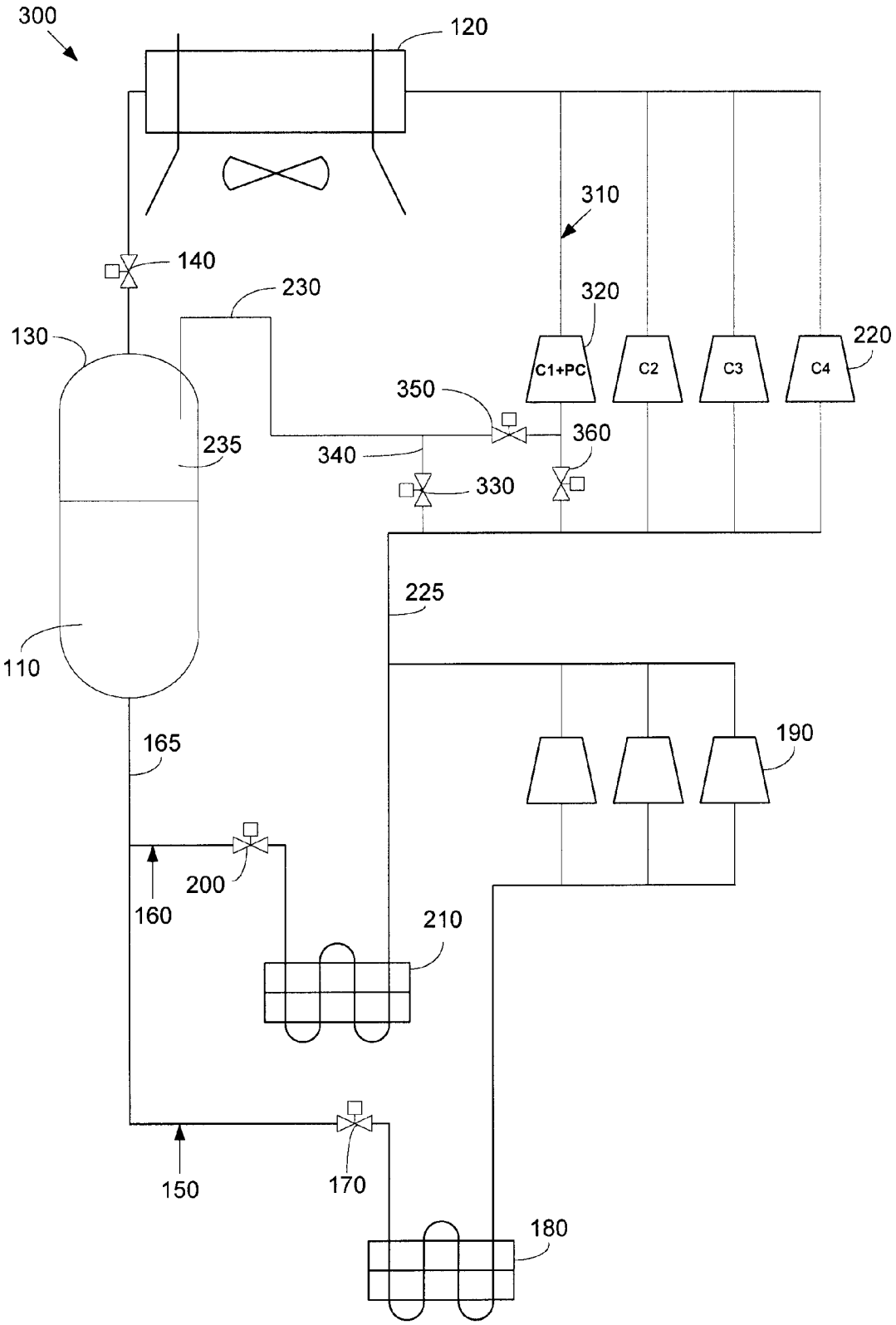
FIG. 2 is a schematic diagram of a transcritical carbon dioxide refrigeration system as may be described herein with the use of modulated, oversized compressors for flash gas bypass.

FIG. 2 shows an example of a transcritical carbon dioxide refrigeration system 300 as may be described herein. The transcritical carbon dioxide refrigeration system 300 may include a number of similar components as are described in the transcritical carbon dioxide refrigeration system 100 above. For example, the transcritical carbon dioxide refrigeration system 300 may include the flow of the carbon dioxide refrigerant 110, the gas cooler 120, the flash tank 130, the high pressure expansion valve 140, the flash gas 235, and similar components. The transcritical carbon dioxide refrigeration system 300 also may include the liquid line 165 extending from the flash tank 130 to the low temperature cycle 150 and the components thereof and to the mid-temperature cycle 160 and the components thereof Other components and other configurations may be used herein.

The transcritical carbon dioxide refrigeration system 300 also may use a modulated, oversized flash gas bypass system 310. The modulated, oversized flash gas bypass system 310 may include one or more oversized flash gas compressors 320. As compared to the mid-temperature compressor 220 and the flash gas compressor 260 described above, the oversized flash gas compressors 320 may have an excess pumping capacity for an overall increase in capacity of about fifty percent (50%), about one hundred percent (100%), or higher. Oversized flash gas compressors 320 of differing capacity may be used herein together. The oversized flash gas compressors 320 may be positioned in a parallel configuration or otherwise. Using one or more oversized compressors 320 may be less expensive that adding additional standalone units to the compressor rack. Specifically, one or more mid-temperature compressors 220 and one or more flash gas compressors 260 may be replaced with an oversized flash gas compressor 320. Other components and other configurations may be used herein.

The modulated, oversized flash gas bypass system 310 also may include a modulated flash gas bypass valve 330. The modulated flash gas bypass valve 330 may be a conventional metering valve and the like. The modulated flash gas bypass valve 330 may be positioned on a bypass line 340. The bypass line 340 may be in communication with the vapor line 230 downstream of the flash tank 130 and the incoming suction line 225. The use of the modulated flash gas bypass valve 330 may be optional. Other component and other configurations may be used herein.

The modulated flash gas bypass system 320 may include a number of port valves. In this example, a first port valve 350 and a second port valve 360 may be used. The port valves 350, 360 may be conventional solenoid valves or other types of open and closed type valves. Other types of valves may be used herein. The first port valve 350 may be positioned on the vapor line 230. The second port valve 360 may be positioned on the suction line 225. Any number of valves may be used herein with any number of oversized compressors 320. The oversized compressors 320 may be individually controlled by the port valves and the bypass valve or controlled collectively as a group. The modulated flash gas bypass valve 330 and the port valves 350, 360 may modulate the flows therethrough as desired. Other components and other configurations may be used herein.

In use, the transcritical carbon dioxide refrigeration system 300 may operate on, for example, a conventional 50/50 duty cycle. In a mid-temperature suction cycle, the first port valve 350 on the vapor line 230 may be closed while the second port valve 360 on the suction line 225 may be open. The oversized compressor 320 then may run for a predetermined amount of time so as to provide about one hundred percent (100%) more capacity than needed for that compressor 320 at about 30 bar. The oversized compressor 320 thus may operate in parallel with the mid-temperature compressors 220. In a flash tank suction cycle, the second port valve 360 may be closed and the first port valve 350 may be opened. The oversized compressor 320 then may run for a pre-determined amount of time so as to provide about one hundred percent (100%) more flash gas removal than needed for that compressor 320 at about 40 bar. The modulated oversized flash gas bypass system 310 then may return to the mid-temperature suction cycle. The oversized compressors 320 may have a variable speed motor such that the speed of the motor may vary in the respective cycles.

To fulfill a 150 kW refrigeration duty cycle, an existing system may use, for example, three (3) compressors corresponding to 75 kW at the mid-temperature suction conditions and two (2) compressors corresponding to 75kW at the flash tank suction conditions (assuming 50% vapor fraction at the flash tank conditions). The flash compressors 260 therefore may be split 50/50 at 37.5 kW and the mid-temperature compressors may be split at 40/30/30 at 25 kW. The transcritical carbon dioxide refrigeration system 300 instead may use the oversized compressor 320 and switch between the two cycles. Thus, the oversized compressor 320 may have about eighty percent (80%) more capacity than the required 37.5 kW at flash tank conditions, leading to about 67.5kW in capacity. The oversized compressor 320 may spend about fifty-five percent (55%) of the duty cycle at the flash tank suction conditions and about forty-five percent (45%) at the mid-temperature conditions to match the 25 kW requirement in which the actual capacity of the compressor would have to be about 55.55 kW. If the capacity of the compressor is larger than the required 55.55 kW at full speed than other method of capacity control may be employed such as partial flash gas bypass or the use of a variable speed drive to control the running frequency of the oversized compressor 320.

The modulated, oversized flash gas bypass system 310 thus may modulate between the mid-temperature suction cycle and the flash tank suction cycle via the port valves 350, 360. The active run time at each suction pressure level may be set to minimize the impact on the overall refrigeration system such as caused by pressure oscillations. Likewise, the modulated flash gas bypass valve 330 and the port valves 350, 360 together may modulate the flows therethrough. The modulated, oversized flash gas bypass system 310 thus offers parallel compression at a significantly reduced cost and with greater flexibility.

Moreover, the modulated flash gas bypass valve 330 also provides flow control therethrough. The overall system thus provides finer capacity stepping by providing uneven compressors to be modulated. Moreover, overall capacity control may be provided. The oversized compressors 320 may be used as a "spare" compressor for parallel compression when needed. Similarly, if the system only requires about 70% of load, the idle capacity may provide further parallel compression herein. The modulated, oversized flash gas bypass system 310 thus may provide a significant increase in capacity with a modest increase in cost.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A refrigeration system using a flow of a carbon dioxide refrigerant, comprising: a flash tank; a plurality of temperature suction compressors for a temperature suction cycle, wherein the plurality of temperature suction compressors receive the flow of carbon dioxide refrigerant from an evaporator; a vapor line; a suction line; a flash gas bypass system positioned between the flash tank and the plurality of temperature suction compressors; the flash gas bypass system comprises one or more oversized flash gas compressors; wherein the one or more oversized flash gas compressors alternate between the temperature suction cycle and a flash tank suction cycle, and the one or more oversized flash gas compressors in the temperature suction cycle receive carbon dioxide refrigerant from the flow of carbon dioxide from the evaporator to the plurality of temperature suction compressors; a first port valve on the vapor line and upstream of the one or more oversized flash gas compressors; and a second port valve on the suction line and upstream of the one or more oversized flash gas compressors, wherein the one or more oversized flash gas compressors are in the temperature suction cycle when the first port valve is closed and the second port valve is open, and the one or more oversized flash gas compressors are in flash tank cycle when the first port valve is open and the second port valve is closed.

2. The refrigeration system of claim 1, wherein the one or more oversized flash gas compressors comprise a capacity of at least about fifty percent (50%) more than a temperature suction compressor.

3. The refrigeration system of claim 1, wherein the one or more oversized flash gas compressors comprise a parallel configuration.

4. the refrigeration system claim 1, wherein the flash tank and the one or more oversized flash gas compressors are in communication via the vapor line.

5. the refrigeration system of claim 4, wherein the suction line in communication with the plurality of temperature suction compressors and the one or more oversized flash gas compressors.

6. The refrigeration system of claim 5, further comprising a bypass valve positioned on a bypass line extending between the vapor line and the suction line.

7. The refrigeration system of claim 1, wherein the first port valve and the second port valve comprise solenoid valves.

8. The refrigeration system of claim 1, wherein the plurality of temperature suction compressors comprises a parallel configuration.

9. The refrigeration system of claim 1, wherein the plurality of temperature suction compressors comprises a plurality of mid-temperature suction cycle compressors.

10. The refrigeration system of claim 1, further comprising a gas cooler positioned between the plurality of temperature suction compressors and the flash tank.

11. The refrigeration system of claim 1, wherein the flash tank comprises a liquid line in communication with a low temperature cycle and a mid-temperature cycle.

12. A refrigeration system using a flow of a carbon dioxide refrigerant, comprising: a flash tank; a plurality of mid-temperature cycle compressors, wherein the plurality of mid- temperature cycle compressors receive the flow of carbon dioxide refrigerant from an evaporator upstream from the plurality of mid-temperature cycle compressors; and a flash gas bypass system positioned between the flash tank and the plurality of mid-temperature cycle compressors; a vapor line; a suction line; wherein: the flash gas bypass system comprises one or more oversized flash gas compressors comprising a capacity of at least about fifty percent (50%) more than a mid- temperature cycle compressor; the one or more oversized flash gas compressors alternate between a temperature suction cycle and a flash tank suction cycle, wherein the one or more oversized flash gas compressors in the temperature suction cycle receives a portion of the flow of the carbon dioxide refrigerant from the evaporator upstream from the plurality of mid-temperature cycle compressors; and a first port valve on the vapor line and upstream of the one or more oversized flash gas compressors and a second port valve on the suction line and upstream of the one or more oversized flash gas compressors, wherein the one or more oversized flash gas compressors are in the temperature suction cycle when the first port valve is closed and the second port valve is open, and the one or more oversized flash gas compressors are in flash tank cycle when the first port valve is open and the second port valve is closed.

13. the refrigeration system claim 12, wherein the flash tank and the oversized flash gas compressors are in communication via the vapor line.

14. the refrigeration system of claim 13, wherein the suction line in communication with the plurality of mid-temperature suction cycle compressors and the one or more oversized flash gas compressors.

15. The refrigeration system of claim 14, further comprising a bypass valve positioned on a bypass line extending between the vapor line and the suction line.

* * * * *